United States Patent [19]

Budert

[11] Patent Number: 4,682,688

[45] Date of Patent: Jul. 28, 1987

[54] SECURED CONTAINER AND LOCKING DEVICE FOR SAME

[75] Inventor: Günter H. Budert, Giengen/Brenz, Fed. Rep. of Germany

[73] Assignee: Firma Georg Knoblauch, Giengen/Brenz, Fed. Rep. of Germany

[21] Appl. No.: 807,453

[22] Filed: Dec. 10, 1985

[30] Foreign Application Priority Data

Jan. 24, 1985 [DE] Fed. Rep. of Germany ... 8501735[U]

[51] Int. Cl.[4] ..... A45C 13/10

[52] U.S. Cl. ..... 206/1.5; 206/601; 206/807; 229/52 A; 220/94 R; 220/315; 16/110 R; 16/114 R; 24/453

[58] Field of Search ..... 206/1.5, 45.14, 461, 206/807, 464, 466, 467, 469, 470, 601, 604, 806; 229/52 A; 24/615, 616, 662, 453, 297; 292/307 R, 307 A, 320, 321, 322; 16/110 R, 114 R; 220/94 R, 94 A, 315

[56] References Cited

U.S. PATENT DOCUMENTS

| | | | |
|---|---|---|---|
| 691,716 | 1/1902 | Doremus | 292/307 A |
| 1,371,210 | 3/1921 | King | 24/616 |
| 2,967,011 | 1/1961 | Trogman | 229/52 A |
| 3,023,925 | 3/1962 | Sher | 206/1.5 |
| 3,157,342 | 11/1964 | Grady | 229/52 A |
| 3,167,218 | 1/1965 | Graham | 206/807 |
| 3,798,711 | 3/1974 | Cousins | 24/616 |
| 4,071,140 | 1/1978 | Rattner | 206/806 |
| 4,106,801 | 8/1978 | De Lima Castro Neto | 292/307 R |
| 4,110,873 | 9/1978 | Verchere | 24/615 |
| 4,349,102 | 9/1982 | Strongwater | 206/806 |
| 4,373,632 | 2/1983 | Van Zandt | 206/806 |
| 4,381,836 | 5/1983 | Rivkin et al. | 206/807 |
| 4,512,484 | 4/1985 | Mar | 206/1.5 |
| 4,531,870 | 7/1985 | Moryl et al. | 24/453 |
| 4,566,660 | 1/1986 | Anscher et al. | 24/453 |

FOREIGN PATENT DOCUMENTS

| | | | |
|---|---|---|---|
| 1279295 | 10/1968 | Fed. Rep. of Germany | 229/52 A |

*Primary Examiner*—Joseph Man-Fu Moy
*Assistant Examiner*—David T. Fidei
*Attorney, Agent, or Firm*—Karl F. Ross; Herbert Dubno

[57] ABSTRACT

A container for protection of objects contained therein comprises a bottom part, a convering part movable against the bottom part to open the container, and a locking pin for locking the container, wherein the locking pin is inserted in a first receiving hole in the covering part and a second receiving hole in the bottom part aligned with the first receiving hole, the locking pin being held by a detent on the locking pin in these receiving holes when mounted in the container. On the free end of the locking pin inserted in the container the locking pin has a catch member preventing the complete withdrawal of the locking pin from the container, and the detent thereon is connected with the catch member by a separating bridge segment, whose length is so chosen that in the partially withdrawn position of the locking pin limited by the catch member, the bridge segment protrudes at least partially from the container so as to be separable therefrom.

7 Claims, 11 Drawing Figures

SECURED CONTAINER AND LOCKING DEVICE FOR SAME

FIELD OF THE INVENTION

My present invention relates to a container in the form of a box, can, cassette, case, cartridge or the like for protection and storage of objects and, more particularly, to a display/storage case or the like for twist drills, taper drills, augers or the like and to a locking device for such a container.

BACKGROUND OF THE INVENTION

A storage, sales-display or like container for objects to be sold but which may continue to be stored in the case by the user, can include a bottom part to hold the objects, a covering part or cover part positionable part to cover the bottom part and movable relative to the bottom part, and a locking pin for closing and locking the container, which is inserted through aligned receiving hole in the covering part and the bottom part.

The locking pin can extend substantially perpendicular to the direction of motion of the covering part or to the walls formed with the receiving holes, and is held in place by a detent on the pin.

In this kind of container the locking pin serves additionaly to hinder unintended or undetected opening, whereby the objects stored therein can be removed or lost.

The portion of the locking pin outside of the container, protruding through a suitable receiving hole, can be constructed so that it allows the hanging-up, mounting or suspension of the container on a conventional rod, bow or bar mounting display device used in self-service business operations for point of sale display.

It is a disadvantage; however, that the locking pin can be withdrawn directly from and replaced in the container which therefore can be opened, so that in a self-service operation there is the danger that objects stored in the case will be removed by unauthorized persons and the container will again be duly closed without observation or detection.

OBJECTS OF THE INVENTION

An object of my invention is to provide a locking pin in a container of the foregoing kind, so that the container is secured against unauthorized opening during normal business operations, that upon the first opening of the container the locking pin fulfills its function of indicating that the container has been opened, thereby securing it against unintended opening, and that the pin can be replaced repeatedly as a single cover securing device.

It is an object of my invention to provide an improved container for protecting and storing objects therein.

It is also an object of my invention to provide an improved container for protecting objects contained therein having an improved locking device. It is another object of my invention to provide a container which is safer from unauthorized opening than those of the prior art.

It is yet another object of my invention to provide a container, which is safe from an unauthorized opening during normal business operations, but can be resecured conveniently and easily, after it is opened.

It is further an object of my invention to provide an improved locking device for a container for improved protection of the contents thereof.

SUMMARY OF THE INVENTION

These objects and others which will be made more apparent hereinafter are attained in a container for the protection and storage of objects contained therein comprising a bottom part to hold the objects, a covering part to cover the bottom part movable relative to the bottom part so as to be able to open the container, and a locking pin for locking the container, which is inserted in a first receiving hole in the covering part and a second receiving hole in the bottom part aligned with the first receiving hole when the locking pin is in place mounted therein, this locking pin being inserted substantially perpendicular to the direction of motion of the cover the walls provided with the holes and held in the vicinity of said first and second receiving holes by detent thereon.

According to my invention the locking pin has on its free end inserted in the container a catch member spaced from the detent and preventing the complete withdrawal of the locking pin from the container, and the notched site is connected with the catch member by a separating bridge segment, whose length is so chosen, that in the partially withdrawn position of the locking pin, limited by the catch member, the locking pin protrudes at least partially from the container, at the bridge so as to be separable from the catch portion which, upon cutting, falls back into the case.

Thus the locking pin partially withdrawn from the container is partly separable therefrom by cutting the separating bridge member with a scissor or knife.

Consequently, the locking pin in an initial opening of the container, cannot be fully pulled out of the aligned or registering bores, but is held back by the catch or detent so that the end of the locking pin carrying the catch member must be cut at the separating bridge segment from the pin, whereupon this end of the locking pin falls back into the container and can be removed from it when the container is opened.

The other part of the locking pin carries at its front, newly defined by the cut, the notched site or detent, so that the container also in later usage can again be secured by the user in the closed position simply by removable insertion of the detent portion of the pin in the registering bores.

The unauthorized opening of the container offered for purchase is thus reliably prevented under normal business conditions, since it requires an aid not normally present in the hands of an individual in normal self-service business operation, such as a knife or a scisssors.

Preferably, the catch member if formed by a resilient blade piece on the locking pin oriented slantedly to the longitudinal axis of the locking pin, the free end of which forms a stopping surface engageable on an inner side of a wall of the container.

This resilient blade piece allows a particularly easy first-time mounting of the locking pin in the container, in which the blade piece itself essentially contacts on insertion of the locking pin and prevents by spreading out the subsequent complete withdrawal of the locking pin.

In a particularly easy way the resilient blade can be cut free from the locking pin, which provides the further advantage that the blade piece in the cutaway region of the locking pin can easily enter in mounting into the container. The mounting of the locking pin can be facilitated further by tapering the free end of the locking pin inserted in the container to form a double wedge-shaped tip.

The notched site or detent is suitably formed from a cross sectional constriction of the locking pin, in which the edges of the second receiving hole of the bottom member engage and just fit, wherein this second receiving hole has a smaller cross sectional area than that of the first receiving hole of the covering part, hereinafter referred to as the cover.

Further it is also advantageous when the second receiving hole in the bottom member is formed by a cylindrical passage therethrough, and the first receiving hole in the covering member has a noncircular or cornered shape so as to prevent rotation of the locking pin mounted therein.

Furthermore my invention includes a locking device for locking two surfaces, walls or the like together comprising a locking pin having a catch member adjacent the free end of the locking pin comprising a resilient blade piece oriented slantedly or inclinedly to the longitudinal axis of the locking pin, a notched site or detent on the locking pin and a separating bridge segment connecting the notched site or detent and catch member, whose length is so chosen that in the partially withdrawn position of the locking pin limited by the catch member, the locking pin protrudes at least partially from the container, so as to be separable therefrom by cutting through the separating bridge member.

BRIEF DESCRIPTION OF THE DRAWING

The above and other objects, features, and advantages of my present invention will become more readily apparent from the following description, reference being made to the accompanying drawing in which:

FIG. 9 is a cutaway top view of a third embodiment of a container according to my invention wherein the container is in the form of a cylindrical can or the like.

SPECIFIC DESCRIPTION

Figure 8:
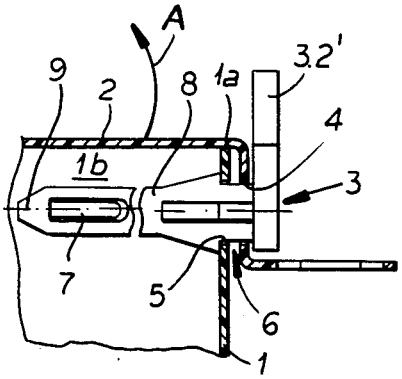
FIG. 8 is a cutaway side cross sectional view of the apparatus of FIG. 7 taken along the line VIII—VIII but with the pin seen in elevation.
Figure 9:
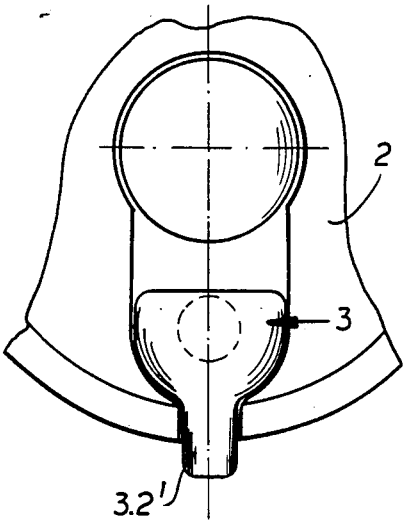
Figure 10:
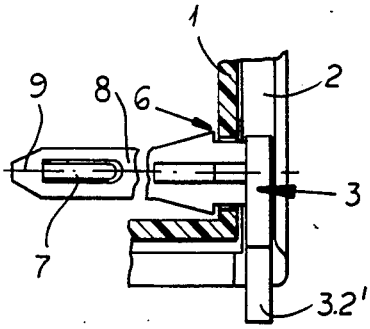
FIG. 10 is a cutaway axial cross sectional view of the apparatus of FIG. 9.

The containers only indicated in the drawing in the form of a box, can or the like are provided for protection and storage of objects, particularly twist drills, taper drills, and the like. They can comprise a bottom part 1 and positionable opposing this a covering part 2. In FIG. 8 the cover 2 can be swung up in the direction of arrow A to uncover an opening **1*b* bounded by a rim 1*a*** through which goods can be inserted or withdrawn.

The container can have, for example, the shape of a box, so the bottom part 1 and the covering part 2 can be mounted pivotally on each other, or contrastingly the container can have the shape of a can, so the covering part 2 can also be connected pivotally with the bottom part 1.

In each case a locking pin 3 for closing and locking the container is provided, which is inserted through first and second receiving holes 4 and 5 substantially aligned or registering with each other in the bottom and covering parts 1 and 2 respectively. The locking pin 3 is oriented substantially perpendicular to the direction (arrow A) in which the covering part 2 is lifted when the container is opened and, of course, perpendicular to the overlapping container walls formed with these openings.

The locking pin 3 itself is held releasably by a retractable notched site or detent 6 thereon in the vicinity of the first and second receiving holes 4 and 5.

On its free end inserted in the container the locking pin 3 has a catch member 7 preventing its complete withdrawal from the container. Thus the locking pin 3 once mounted in the container can no longer be completely withdrawn, and thus the container cannot be completely opened without breaking the locking pin 3.

Note that while the detent 6 can be pulled outwardly past the holes 4 and 5, the catch pawl 7 engages the wall of member 1 (FIG. 6) to prevent further extraction.

Figure 6:
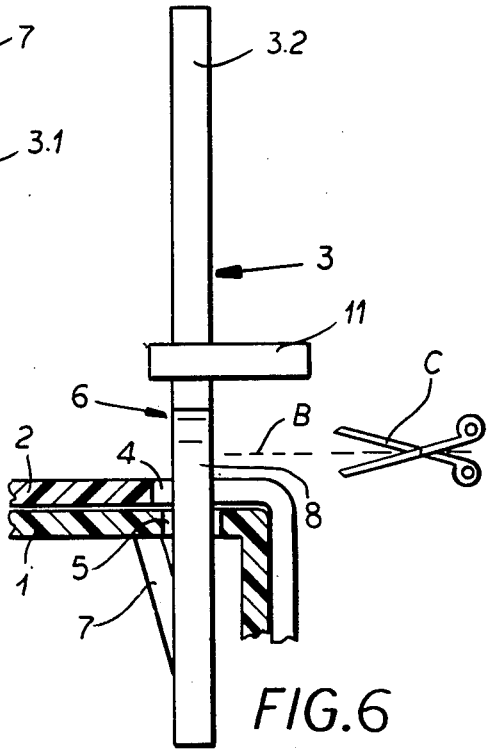
FIG. 6 is a side view of the locking pin of FIG. 2 similar to FIG. 5, but with the locking pin partially withdrawn from the container for cutting.
Figure 7:
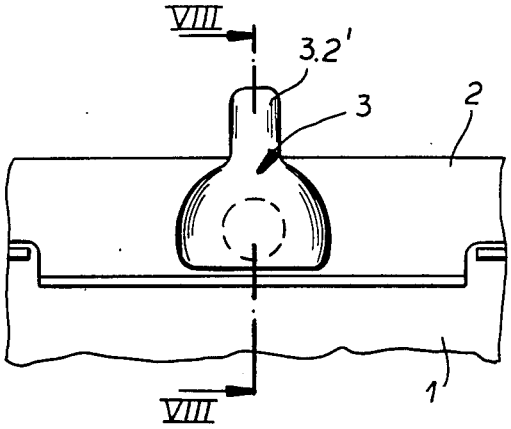
FIG. 7 is a cutaway top plan view of a second embodiment of a container according to my invention, wherein the container is in the form of a box or cassette.

The notched site or detent 6 is connected by separating bridge segment 8 with the catch member 7, the length of the separating bridge segment 8 being so chosen that in the partially drawn out or withdrawn position limited by the catch member 7 according to FIG. 6 the bridge of the locking pin 3 protrudes at least partially from the container.

Figure 1:
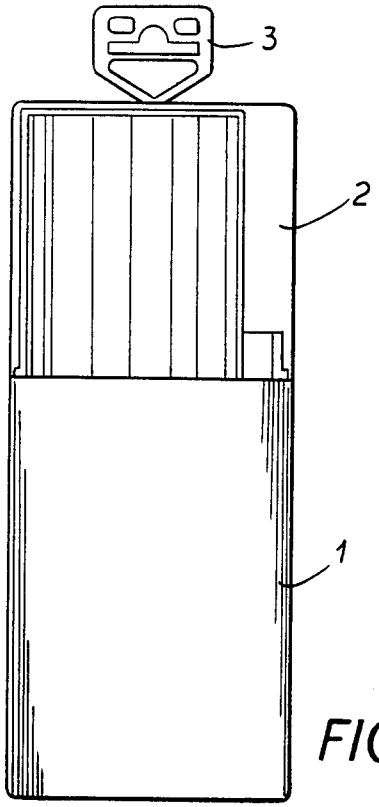
FIG. 1 is a front plan view of a preferred embodiment of a container with a locking pin according to my invention.
Figure 4A:
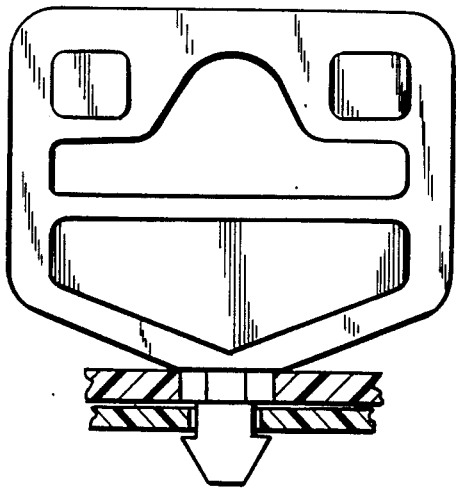
FIG. 4A is a view similar to FIG. 4 showing the device upon relocking.

Thus after the partial withdrawl of the locking pin 3, the catch member 7 is separated in the vicinity of the separating bridge segment 8 in the way shown in FIG. 6, i.e. by cutting along the line B with a scissor C so that the catch member 7 falls back into the inside of the container and the rest of the locking pin 3 is removed. Since the notch site or detent 6 is retained on the pin, the locking pin 3 can again be inserted into the shut container (FIG. 4A). Therefore the locking pin 3 provides some protection against unintended opening after the initial opening and renders the initial opening readily detectable.

The catch member 7 is formed from a resilient blade piece running slantedly to the longitudinal axis of the locking pin 3, a free end of which forms a stopping surface 7.1 directed toward an inner side of a wall of the container. The blade can be presse into an opening 7.2 and is one piece with the pin at the junction 7.3 therewith.

Figure 2:
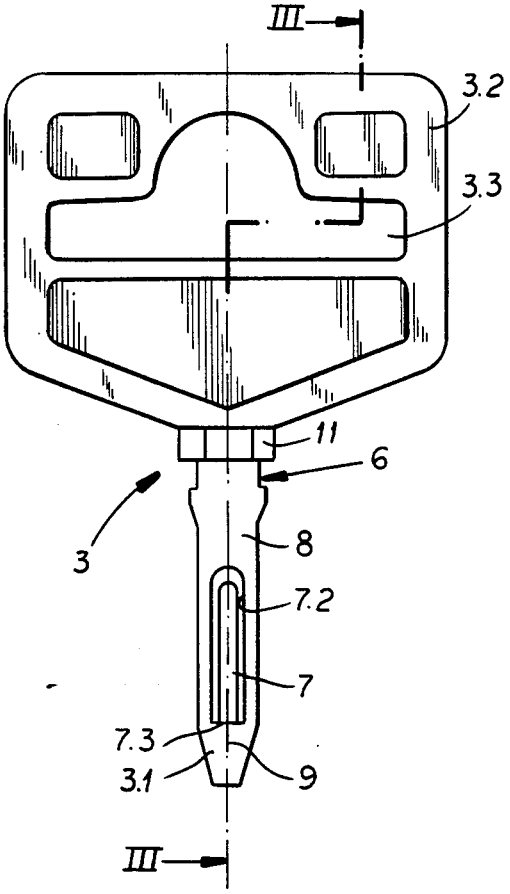
FIG. 2 is a front view of the locking pin of the apparatus of FIG. 1.
Figure 3:
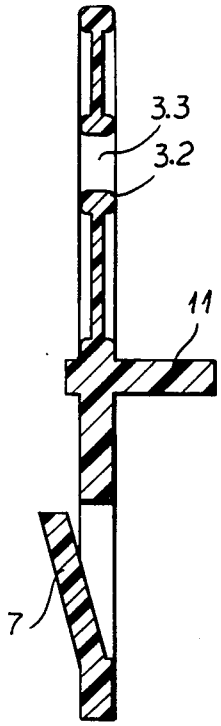
FIG. 3 is a cross sectional view of the locking pin shown in FIG. 2 taken along the line III—III in FIG. 2.
Figure 4:
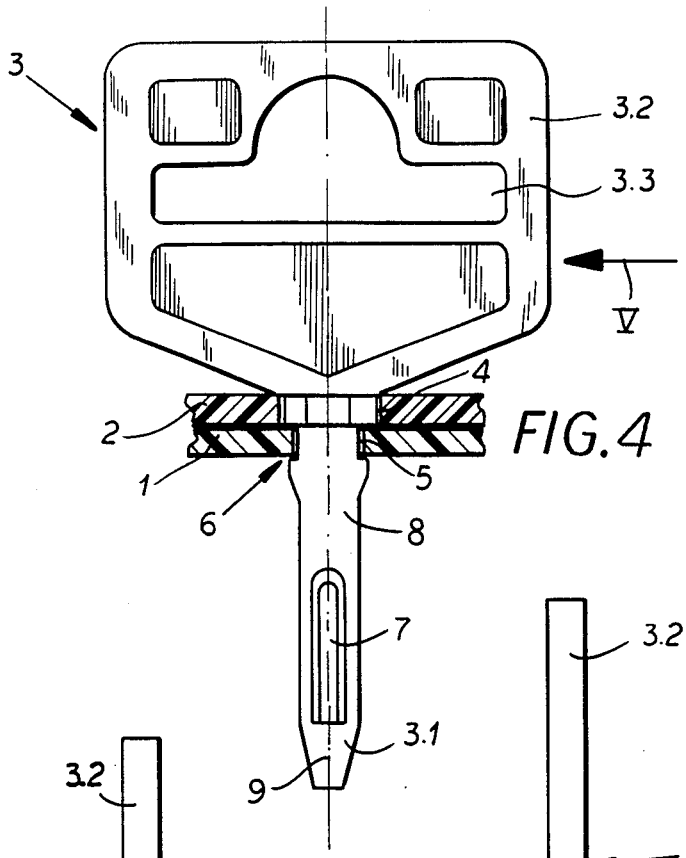
FIG. 4 is a front view of the locking pin of FIG. 2 inserted in place in the container of FIG. 1 prior to intital opening.
Figure 5:
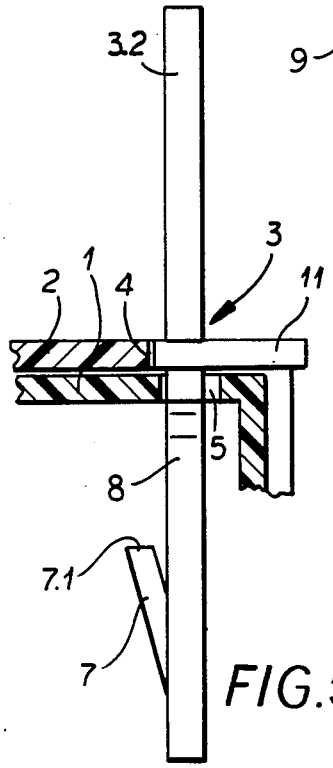
FIG. 5 is a side view of the locking pin of FIG. 2 in the container in the position shown in FIG. 4 taken in the direction of arrow V of FIG. 4.

The resilient blade piece is, as is apparent from FIGS. 2 and 4, sheared or cut freely from the locking pin 3.

In order to facilitate insertion of the locking pin 3 into the container, it is tapered on its free end 9 inserted in the container to form a double wedge shaped tip 9.

The notched site or detent 6 is formed from a cross sectional constriction in which the edges of the second receiving hole 5 of the bottom part 1 engage and fit.

This second receiving hole 5 has a smaller cross sectional surface area than the first receiving hole 4 of the covering part 2. The second receiving hole 5 is preferably formed in the bottom part 1 as a cylindrical passage, while the first receiving hole 4 in the covering member 2 has a noncircular cross sectional shape with corners for receiving and holding the locking pin 3 nonrotatably. The locking pin 3 may be provided with a noncircular collar 11 which fits in first receiving hole 4.

The locking pin 3 can be formed in particular in a way which is apparent from FIGS. 2 to 6, that is, provided with a handle 3.2 extended in the axial direction of the locking pin 3, which at the same time be a suitable opening 3.3 for suspending, mounting or hanging it up on a bow-or-bar-shaped mounting device. Alternatively, the locking pin 3 can be formed as is apparent from FIGS. 7 to 10, in which the handle 3.2 extends in a radial direction, and does not project in the axial direction over the container outer surfaces, so that especially the round cans can be stacked on top of one another.

I claim:

1. A locking device for locking two parts of a container together, said parts of said container having aligned openings through which said device can be inserted to retain said parts in a closed position relative to one another, said device comprising:

a handle adapted to be gripped by a user desiring to open and close said container, said handle being wider than said openings so that said handle remains external of said container when said device is inserted in said openings;

a shank connected to said handle and of a length generally equal to a thickness of said container traversed by said device in a locking position of said device in said openings;

a detent connected to said shank and having at least one stop surface extending transverse to said shank and engageable with an inner wall of said container for retaining said device against withdrawal from said openings, and surfaces converging away from said handle to facilitate insertion of said detent through said openings, thereby enabling said stop surface to engage said wall; and an elongated blade-shaped tongue extending away from said detent in line with said shank and formed with an outwardly projecting yieldable barb converging toward said tongue away from said handle and having a deflectable end turned toward said handle but spaced from said detent by a bridge piece of said tongue whose length is greater than said thickness and which can be cut through so that, upon withdrawal of said detent from said container, enough of said bridge piece is exposed outside said container to permit said bridge piece to be cut through, whereby a tongue portion carrying said barb can fall into said container but said detent remains on said handle to permit reinsertion of said detent into said container to relock the same.

2. The locking device defined in claim 1 wherein said handle, said detent and said tongue are unitary with one another.

3. The locking device defined in claim 2 wherein said tongue has a tapered end remote from said handle.

4. The locking device defined in claim 3 wherein said detent is a wedge-shaped formation coplanar with said tongue and said shank, said barb projecting out of the plane of said detent, said shank and said tongue.

5. The locking device defined in claim 4 wherein said handle has a hole for hanging up said container and is flat to lie in said plane.

6. The locking device defined in claim 3 wherein said handle lies generally transversely to a plane of said tongue.

7. The locking device defined in claim 6 wherein said detent comprises a plurality of wedge-shaped formations including wedge-shaped formations in said plane and wedge-shaped formations perpendicular to said plane.

* * * * *